US010307655B1

(12) United States Patent
Dorsey

(10) Patent No.: US 10,307,655 B1
(45) Date of Patent: Jun. 4, 2019

(54) FOOTBALL TRAINING DEVICE AND METHOD

(71) Applicant: Kenneth S. Dorsey, Charlotte, NC (US)

(72) Inventor: Kenneth S. Dorsey, Charlotte, NC (US)

( * ) Notice: Subject to any disclaimer, the term of this patent is extended or adjusted under 35 U.S.C. 154(b) by 372 days.

(21) Appl. No.: 14/835,785

(22) Filed: Aug. 26, 2015

Related U.S. Application Data

(60) Provisional application No. 62/042,319, filed on Aug. 27, 2014.

(51) Int. Cl.

| | |
|---|---|
| ***A63B 69/34*** | (2006.01) |
| *A63B 63/00* | (2006.01) |
| *A63B 69/00* | (2006.01) |

(52) U.S. Cl.
CPC ..... *A63B 69/345* (2013.01); *A63B 63/00* (2013.01); *A63B 69/002* (2013.01); *A63B 69/0071* (2013.01); *A63B 69/34* (2013.01); *A63B 2208/0204* (2013.01); *A63B 2243/007* (2013.01)

(58) Field of Classification Search
CPC ..... A63B 69/345; A63B 69/002; A63B 69/00; A63B 63/00; A63B 2243/007; A63B 69/34; A63B 69/0071; A63B 2208/0204
USPC ..... 473/438, 441, 445, 470, 422, 440
See application file for complete search history.

(56) References Cited

U.S. PATENT DOCUMENTS

| | | | | |
|---|---|---|---|---|
| 3,391,936 | A * | 7/1968 | Grimes | A63B 69/002 473/439 |
| 3,675,921 | A * | 7/1972 | Meyers, Sr. | A63B 69/0071 473/448 |
| 6,599,206 | B1 * | 7/2003 | Forrest, Sr. | A63B 69/345 473/438 |
| 6,685,581 | B2 * | 2/2004 | Krause | A63B 69/004 473/441 |
| 6,796,915 | B2 * | 9/2004 | Getchell | A63B 69/0024 473/438 |
| 6,866,595 | B1 * | 3/2005 | Elder | A63B 69/002 473/444 |
| 7,070,521 | B2 * | 7/2006 | Bayduke | A63B 69/345 473/438 |
| 7,658,689 | B2 * | 2/2010 | Crook, II | A63B 69/345 473/422 |
| 8,900,076 | B1 * | 12/2014 | Shropshire | A63B 69/002 473/439 |
| 2005/0272534 | A1 * | 12/2005 | Bayduke | A63B 69/345 473/438 |

(Continued)

*Primary Examiner* — Mitra Aryanpour
(74) *Attorney, Agent, or Firm* — Tillman Wright, PLLC; James D. Wright; David R. Higgins

(57) ABSTRACT

A football training device for replicating a defensive rush includes a base frame, a plurality of obstacles extending upward from the base frame, and one or more wheels supporting the base frame. A method of training an offensive football player using the device includes positioning an offensive football player being trained on front of the training device, initiating a drill where the offensive football player carries out a conventional football play, and while the offensive football player carries out the conventional football play, moving the training device, relative to the offensive football player, such that the obstacles simulate a defensive rush toward the offensive player, thereby creating a visual and physical barrier to the completion of the conventional football play.

19 Claims, 19 Drawing Sheets

(56) References Cited

U.S. PATENT DOCUMENTS

2007/0099730 A1* 5/2007 Driver ..... A63B 69/0002
473/422

* cited by examiner

FOOTBALL TRAINING DEVICE AND METHOD

CROSS-REFERENCE TO RELATED APPLICATION

The present application is a U.S. nonprovisional patent application of, and claims priority under 35 U.S.C. § 119(e) to, U.S. provisional patent application Ser. No. 62/042,319, filed Aug. 27, 2014, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to football training devices and methods, and, in particular, to devices used to train a football player by mimicking the experience presented by a defensive rush.

Background

A wide variety of devices have been developed to assist in the training of athletes. Some such devices are designed to provide physical conditioning, while others are designed to help replicate some aspect of a particular sport so as to provide an enhanced experience for an athlete in training for that aspect.

Various devices have been developed specifically for training football players, and more particularly for replicating various aspects of football training. Examples of such devices include tackling dummies and sleds, chutes for linemen, throwing targets for quarterbacks, and the like.

In at least some aspects, many of these devices are intended to represent, in some way, another player. For example, a tackling dummy represents an opposing player to be tackled or blocked; a throwing target represents a receiver. For this reason, some of these devices may take on the appearance, at least superficially, of an opposing player.

More recently, at least one multi-sport device has been developed specifically to represent an opposing player to be avoided, rather than targeted. The "D-Man" product, available from Pro Performance Sports, LLC d/b/a SKLZ of Carlsbad, Calif., is a lightweight mesh mannequin that may be stationed on a court or field to provide an obstacle for a training athlete. The mannequin takes the form of a silhouette of another player with his raised over his head in a defensive posture, such as a defensive basketball player might take in defending against a shot by an offensive player.

This product may also be positioned (supported on a base or staked into the ground) on a football field to provide a stationary obstacle for a running back or the like, with a set of such products being arranged to provide something of an obstacle course. However, once positioned, the product is generally stationary, which greatly limits its usefulness in training for situations involving movement of opposing players. Furthermore, if a group of such products are to be used, they must all be placed and/or moved independently, which further decreases such usefulness.

One particular type of specialized training in football involves preparing for the onrush of defensive players trying to block an airborne football. For example, a quarterback must prepare for the experience of defensive linemen rushing at him to tackle him, to block a pass, or otherwise force an incomplete pass. Similarly, kickers must prepare for defensive players of various types trying to block a field goal or extra point try. In each case, it can be difficult to create an experience for the quarterback, kicker, or other player in which the feeling of being rushed by the defense is replicated. For example, it can be difficult for a quarterback to go through drills in which he must imagine a pocket collapsing on him, or defensive pressure causing him to move around on the field, without actually being presented with any physical representation of such experiences.

To this point, the only way to replicate a defensive rush, for example, is to actually line players up and have them rush the quarterback. However, this requires multiple personnel, thereby consuming time and energy, and diverting those personnel from other training tasks. Unfortunately, no other devices are available to create this experience for a quarterback, kicker, or the like. Thus, a need exists for a device that makes it easy for a single coach or trainer to create a physical environment replicating the rush of a group of defensive players.

SUMMARY OF THE PRESENT INVENTION

Broadly defined, the present invention according to one aspect is a football training device for replicating a defensive rush, including: a base frame; a plurality of obstacles extending upward from the base frame; and one or more wheel assemblies supporting the base frame; wherein the base frame may be pushed or pulled over a football field to simulate a defensive rush for a quarterback, kicker, punter, or other offensive football player while executing a drill.

In a feature of this aspect, each obstacle includes a mannequin, a support member or frame, and a mount, wherein the support member or frame is connected to the base frame via the mount and wherein the mannequin is carried on the support member or frame. In further features, each mannequin is in the form of a silhouette of a human body; each mannequin includes a panel of cloth mesh; and/or each mannequin includes a wire frame on which the panel of cloth mesh is carried.

In another feature of this aspect, the football training device further includes a handle, connected to the base frame, for pushing or pulling the base frame, thereby imparting movement to the device. In a further feature, the handle has a height that is adjustable to provide greater control for a person pushing or pulling the device.

In another feature of this aspect, the obstacles resemble the approximate size and shape of human figures representing defensive players rushing the offensive football player. In a further feature, each obstacle has a height that is adjustable.

In another feature of this aspect, the base frame is "U"-shaped or arced as viewed from above. In a further feature, the "U"-shape of the base frame comprises at least three intersecting line segments formed by interconnecting portions of the base frame.

In another feature of this aspect, the plurality of obstacles are arranged in a "U" or arc when viewed from above so as to simulate a defensive rush against the offensive football player.

In another feature of this aspect, each obstacle extends upward to an elevation of between five and a half feet and eleven feet above the ground. In a further feature, each obstacle extends upward to an elevation of between six and a half feet and nine and a half feet above the ground.

In another feature of this aspect, the obstacles extend vertically from the base frame.

Broadly defined, the present invention according to another aspect is a football training device for replicating a defensive rush, including: a base frame; at least three obstacles extending upward from the base frame and arranged to partially surround a central area in which a quarterback, kicker, punter, or other offensive football player may move while executing a drill; and one or more wheel assemblies supporting the base frame; wherein the base frame may be pushed or pulled over a football field, thereby moving the central area relative to the offensive player while executing the drill.

In a feature of this aspect, each obstacle includes a mannequin, a support member or frame, and a mount, wherein the support member or frame is connected to the base frame via the mount and wherein the mannequin is carried on the support member or frame.

In another feature of this aspect, the football training device further includes a handle, connected to the base frame, for pushing or pulling the base frame, thereby imparting movement to the device, the handle having a height that is adjustable to provide greater control for a person pushing or pulling the device.

In another feature of this aspect, the obstacles resemble the approximate size and shape of human figures representing defensive players rushing the offensive football player, wherein each obstacle has a height that is adjustable, and wherein each obstacle extends upward to a maximum elevation of between five and a half feet and eleven feet above the ground.

Broadly defined, the present invention according to another aspect is a football training device for replicating a defensive rush, including: a base frame having at least three segments, each of the three segments being an elongate member, wherein the at least three segments include a central elongate member, a first elongate wing member extending from a first end of the central elongate member, and a second elongate wing member extending from a second end of the central elongate member such that the first and second elongate wing members are separate from each other and define a central area therebetween; a plurality of mannequin obstacles, wherein each mannequin extends upward from a respective segment of the base frame; and at least three wheel assemblies supporting the base frame, the wheel assemblies being spaced apart along the extent of the base frame; wherein the base frame may be pushed or pulled over a football field, thereby moving the central area relative to an offensive player while executing a drill.

Broadly defined, the present invention according to another aspect is a football training device for replicating a defensive rush, including: a base frame; a plurality of obstacles extending upward from the base frame; and one or more wheels supporting the base frame; wherein the base frame may be pushed or pulled over a football field to simulate a defensive rush for a quarterback, kicker, punter, or other offensive football player while executing a drill.

In a feature of this aspect, the football training device further includes a handle, connected to the base frame, for pushing or pulling the base frame, thereby imparting movement to the device. In a further feature, a height of the handle is adjustable to provide greater control for a person pushing or pulling the device.

In another feature of this aspect, the obstacles resemble the approximate size and shape of human figures representing defensive players rushing the offensive football player. In a further feature, the height of the obstacles is adjustable.

In another feature of this aspect, the base frame is "U"-shaped or arced.

In another feature of this aspect, the obstacles are arranged in a "U" or arc when viewed from above so as to simulate a defensive rush against the offensive football player.

Broadly defined, the present invention according to another aspect is a method of training an offensive football player by using a football training device to replicate a defensive rush, the method including: providing a training device, the device including: a base frame, a plurality of obstacles extending upward from the base frame, and one or more wheels supporting the base frame; positioning an offensive football player being trained in front of the training device; initiating a drill where the offensive football player carries out a conventional football play; and while the offensive football player carries out the conventional football play, moving the training device, relative to the offensive football player, such that the obstacles simulate a defensive rush toward the offensive player, thereby creating a visual and physical barrier to completion of the conventional football play.

In a feature of this aspect, the providing step includes providing a training device having a handle, connected to the base frame, for pushing or pulling the base frame, thereby imparting movement to the device, and wherein the moving step includes using the handle to move the training device.

In another feature of this aspect, a height of the handle is adjustable to provide greater control for a person pushing or pulling the device.

In another feature of this aspect, the providing step includes providing a training device having obstacles that resemble the approximate size and shape of human figures representing defensive players rushing the offensive football player. In a further feature, the method further includes a step of adjusting a height of the obstacles to accommodate a particular age group or skill level of offensive football players.

In another feature of this aspect, the providing step includes providing a training device whose base frame is "U"-shaped or arced.

In another feature of this aspect, the providing step includes providing a training device whose obstacles are arranged in a "U" or arc when viewed from above so as to simulate the defensive rush against the offensive football player.

In another feature of this aspect, moving the training device relative to the offensive football player includes pushing the training device toward the offensive football player.

In another feature of this aspect, moving the training device relative to the offensive football player includes rotating or pivoting the training device relative to the offensive football player.

In another feature of this aspect, the offensive football player is a quarterback and the conventional football play includes dropping back, by the quarterback, to throw a football, and subsequently throwing the football while attempting to avoid hitting the obstacles on the training device with the football.

In another feature of this aspect, the offensive football player is a kicker and the conventional football play includes attempting to kick a football through a pair of football uprights while also attempting to avoid hitting the obstacles on the training device with the football.

In another feature of this aspect, the offensive football player is a punter and the conventional football play includes punting a football while also attempting to avoid hitting the obstacles on the training device with the football.

In another feature of this aspect, the step of moving the training device is carried out by a single coach or trainer.

Broadly defined, the present invention according to another aspect is a football training device for replicating a defensive rush, as shown and described.

Broadly defined, the present invention according to another aspect is a method of training an offensive football player by using a football training device to replicate a defensive rush, as shown and described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
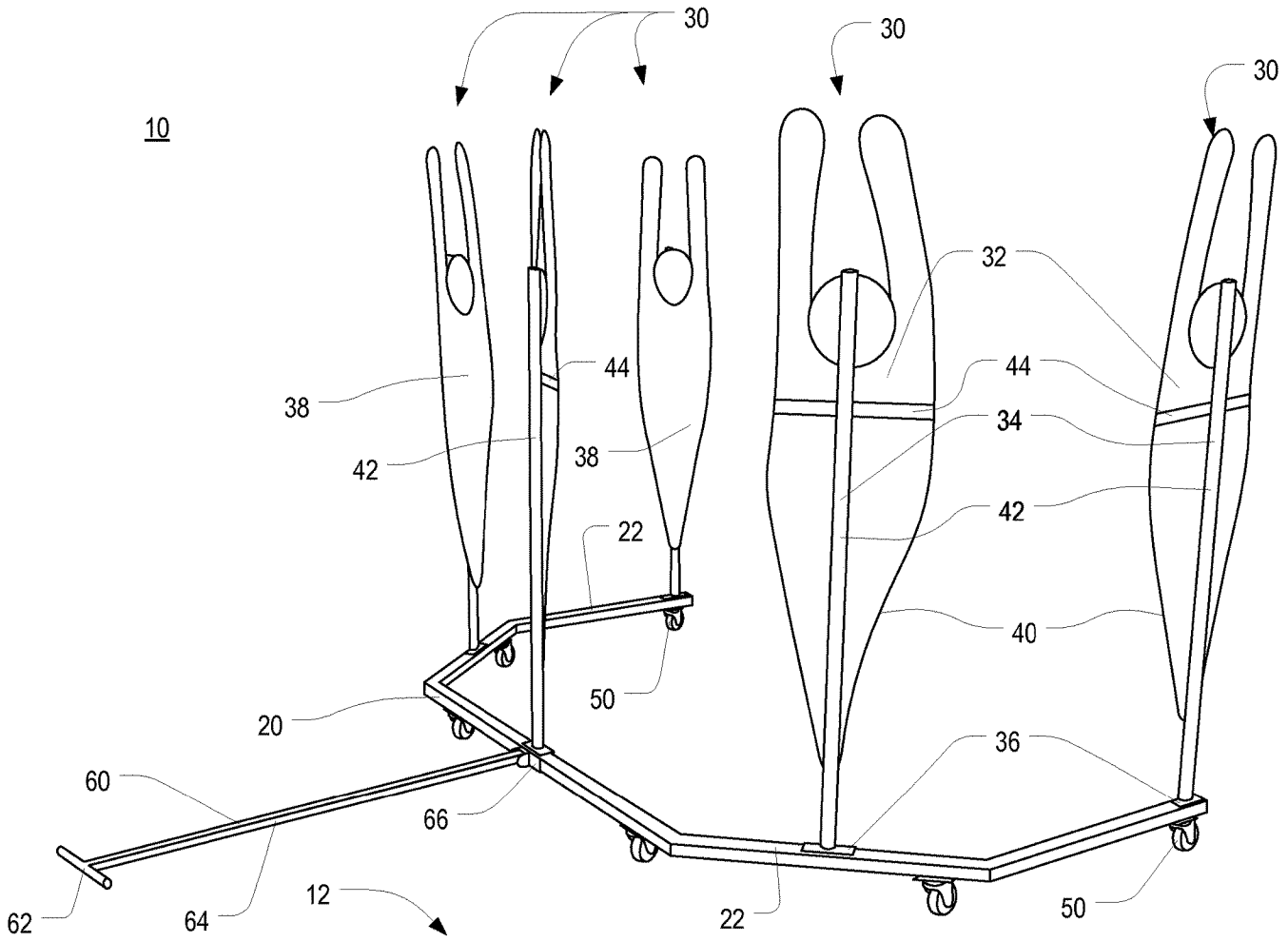
FIG. 1 is a front perspective view of a football training device for replicating a defensive rush in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a front perspective view of a football training device 10 for replicating a defensive rush in accordance with one or more preferred embodiments of the present invention. As shown therein, the device 10 includes a base frame 20, a plurality of obstacles 30, a plurality of wheel assemblies 50, and a handle 60.

The base frame 20 is a support structure providing mounting locations for the obstacles 30. In order to minimize the area covered by the base frame 20 itself, the base frame 20 preferably takes the form of one or more elongated frame members 22 arranged to form a line, "U", "V", arc, or multi-segment portion of a polygon. For example, in the illustrated embodiment, the base frame 20 includes five frame members 22 arranged approximately in the form of a half-octagon. The frame members 22 preferably utilize a combination of light weight, strength, and durability so as to withstand repeated usage on a football field 12. In at least some embodiments, multiple frame members 22 may be welded, bolted, or otherwise connected together. In at least some embodiments, the frame members 22 are pieces of tubular aluminum that are welded together, but in some embodiments, other materials may be used, including wood, PVC pipe, or the like.

The obstacles 30 are supported on the base frame 20. In at least some embodiments, each obstacle 30 includes a mannequin 32, a support member or frame 34, and a mount 36 for connecting the support member 34 to the base frame 20. In order to lower the overall weight of the device 10, each obstacle 30 preferably utilizes a very lightweight mannequin 32, which may take the form of a silhouette of a human body. Such a mannequin 32 may be produced from plastic, cloth, lightweight metals, or the like. In the illustrated embodiment, the mannequins 32 are produced from nylon or other cloth mesh 38 carried on a wire frame 40. In at least some embodiments, including the one illustrated, each mannequin 32 takes on the appearance of a human with his arms raised over his head so as to simulate the appearance, for example, of a defensive lineman that is attempting to block a pass or kick. The mannequins 32 are preferably of a size (particularly height and width) so as to match the typical size of football players at the age group or skill level of players with whom the training device 10 is being used. For example, in an embodiment used to train college or professional football players, the mannequins may have a size (particularly height and width) corresponding to a man that is six feet tall and weighs 250 lbs, while in an embodiment used to train youth football players, the mannequins may have a size (particularly height and width) corresponding to a boy that is five feet tall and weighs 120 lbs. The overall elevation of the top of the obstacles 30 is preferably between five and a half feet and eleven feet, and more preferably between six and a half feet and nine and a half feet so as to correspond to the vertical reach of an opposing football player.

The mannequin 32 is carried on the support member or frame 34, which in turn is connected to, and supported by, the base frame 20. The support member or frame 34 is any mechanical structure that supports the mannequin 32 in an upright position on the base frame 20. A simple post 42, perhaps supplemented with a cross-member 44, may be enough to provide the necessary support for the mannequin 32. The mount 36 may be welded, bolted, or the like to the bottom of the support frame 34 and is preferably removably connected to the base frame 20 so that the device may be dissembled for storage, transport, or the like. The wheel assemblies 50 include a wheel carried by a chassis that is connected to the bottom or other portion of the base frame 20. The wheel and chassis may be of any conventional type that is suitable for use on outdoor terrain such as a football field. In the illustrated embodiment, the wheel assemblies 50 may be solid-wheel casters, but in other embodiments, they may, for example, be pneumatic wheels. In at least some embodiments, all of the wheels are arranged to be rolled in any direction, rather than in only a fixed direction, while in other embodiments, one or more of the wheels are arranged to be rolled only in a fixed direction.

Figure 2:
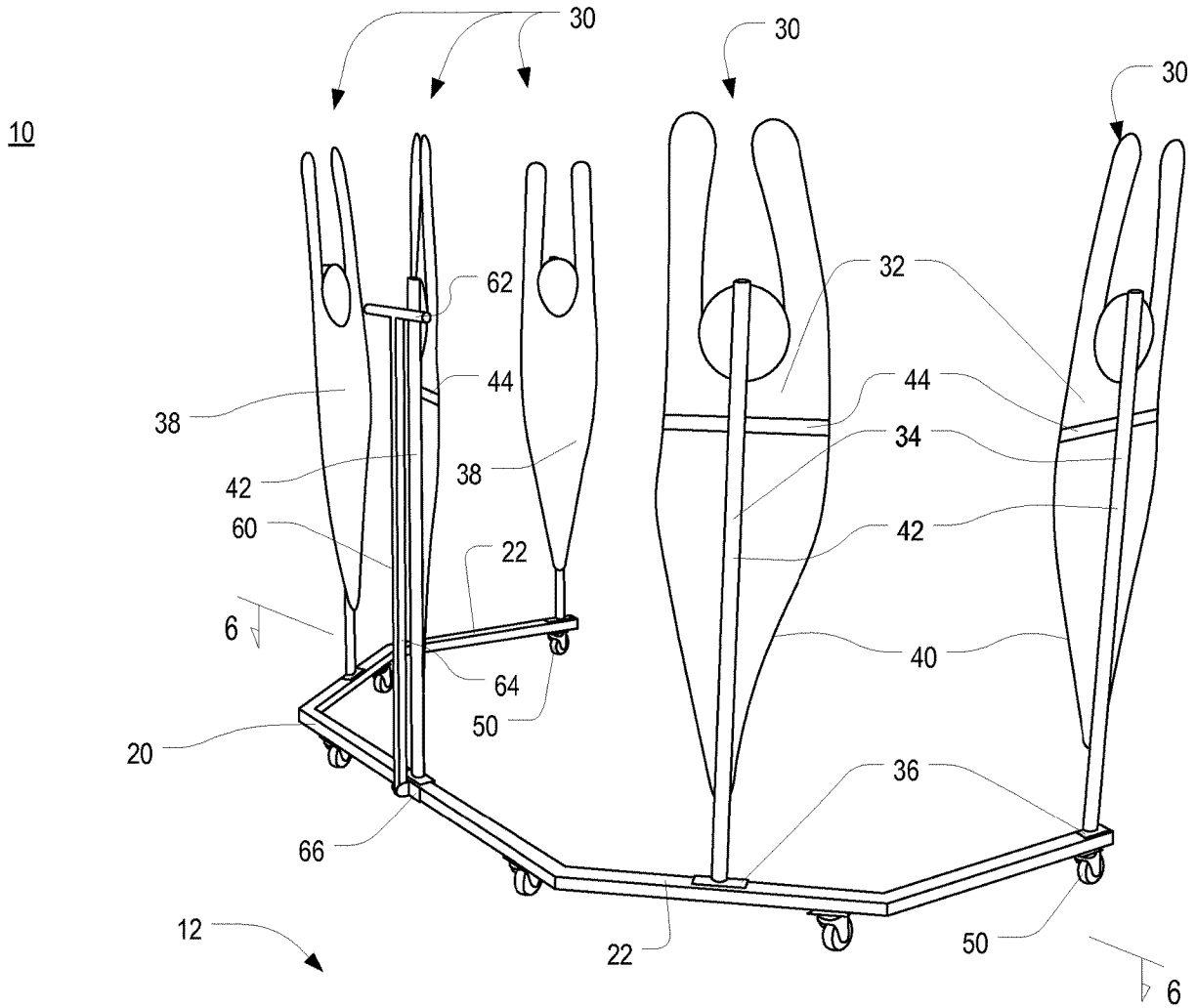
FIG. 2 is a front perspective view of the football training device of FIG. 1, shown in a non-use or storage state.

The handle 60 is attached to base frame 20 to provide means for a coach, trainer, equipment manager, or other personnel to move the device 10. The handle 60 includes a grip 62, an extension member 64, and a hinge assembly 66. The grip 62 provides a convenient structure at a distal end of the extension member 64 for a user 14 (shown in FIG. 3) to impart movement to the device 10. The extension member 64 is preferably about six feet in length and may be folded up out of the way when not in use. In this regard, FIG. 2 is a front perspective view of the football training device 10 of FIG. 1, shown in a non-use or storage state. Folding the handle 60 is facilitated by the hinge assembly 66, which also allows a user 14 to adjust the height of the grip 62 for the convenience of the user 14.

Figure 3:
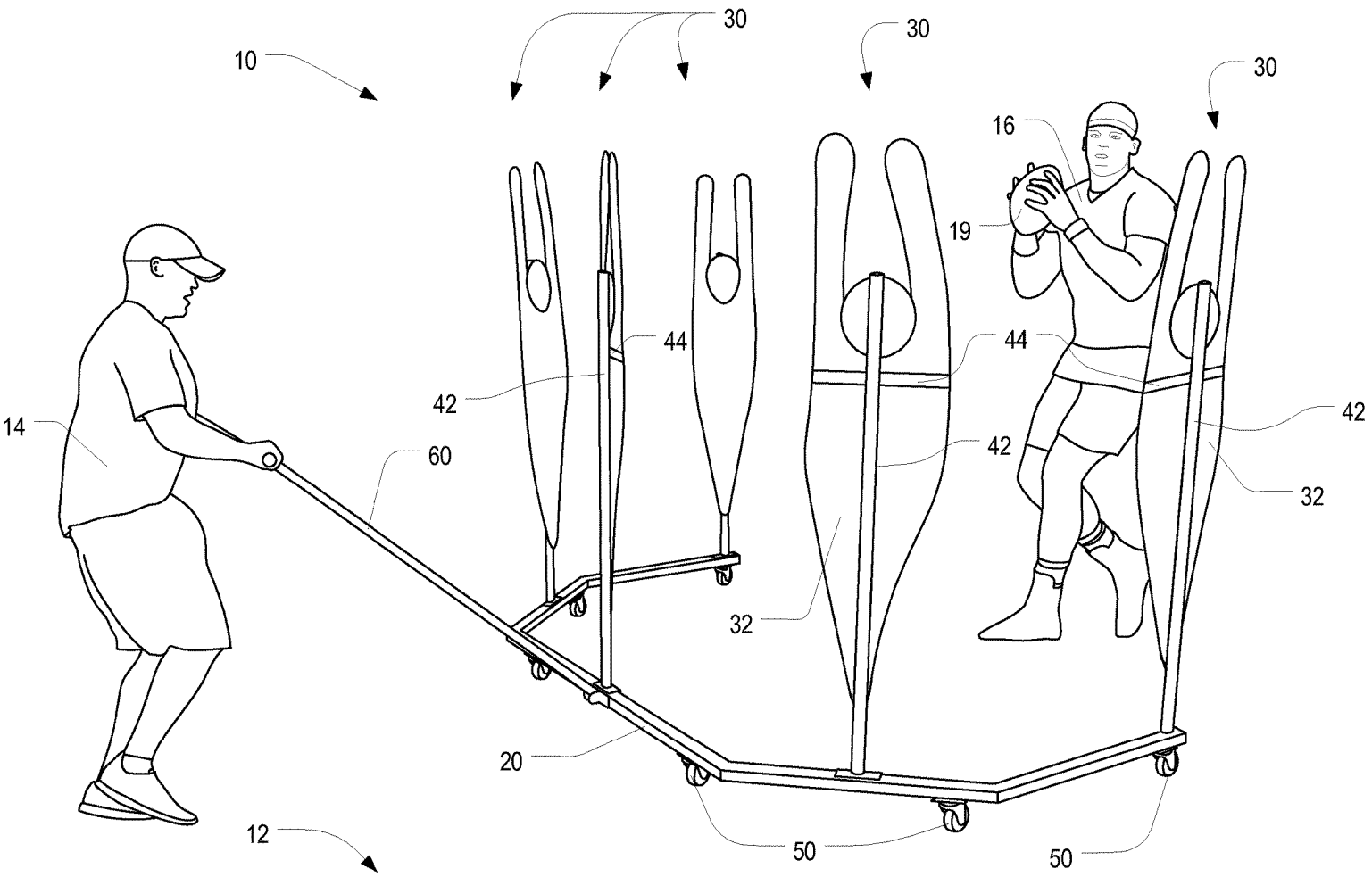
FIG. 3 is a perspective view of the football training device of FIG. 1, shown being used by a coach to train a quarterback to react to a defensive rush.

FIG. 3 is a perspective view of the football training device 10 of FIG. 1, shown being used by a coach to train a quarterback to react to a defensive rush. As shown therein, a quarterback 16 can practice various passing drills using the device 10, wherein the mannequins 32 serve as obstacles (simulating defensive players), both physically and visually, for the quarterback 16 as he attempts to pass a football. The position of the device 10 may be controlled by a coach or trainer 14 via the handle 60. In particular, the coach 14 can push or pull the handle 60 to impart motion to the base frame 20 and the mannequin obstacles 30 carried thereby. Movement of the frame 20 over the ground 12 (usually a football field, which may be a regulation field, training field, or the like) is facilitated by the wheel assemblies 50, which permit the device 10 to be rolled. Furthermore, if at least some of the wheels are arranged to be rolled in any direction, the base frame 20 may be pivoted on the field 12; such movement may be created by the coach 14 to simulate other situations, such as a defensive lineman evading a block by an offensive player and rushing the quarterback 16.

Figure 4A:
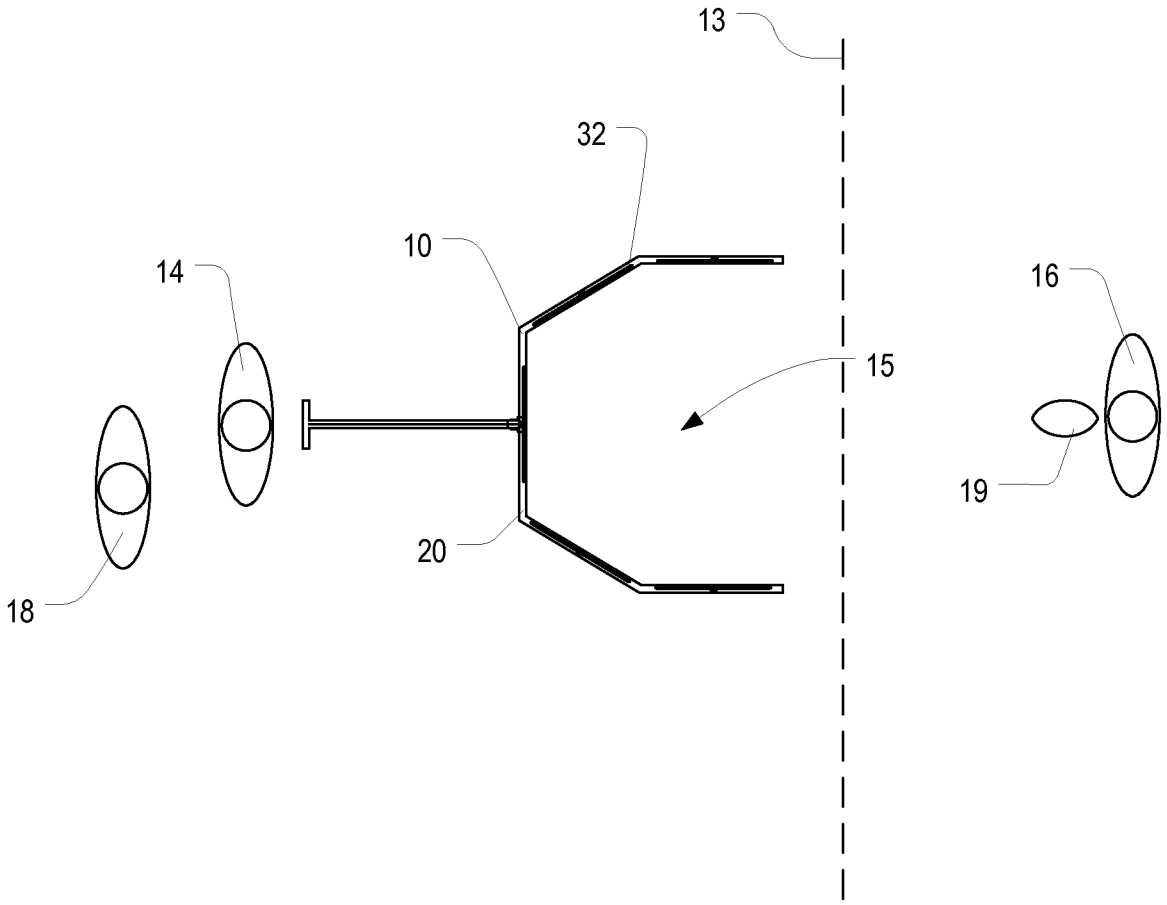
FIGS. 4A-4G are overhead schematic views of the football training device, coach, and quarterback of FIG. 3, illustrating a first drill.
Figure 4B:
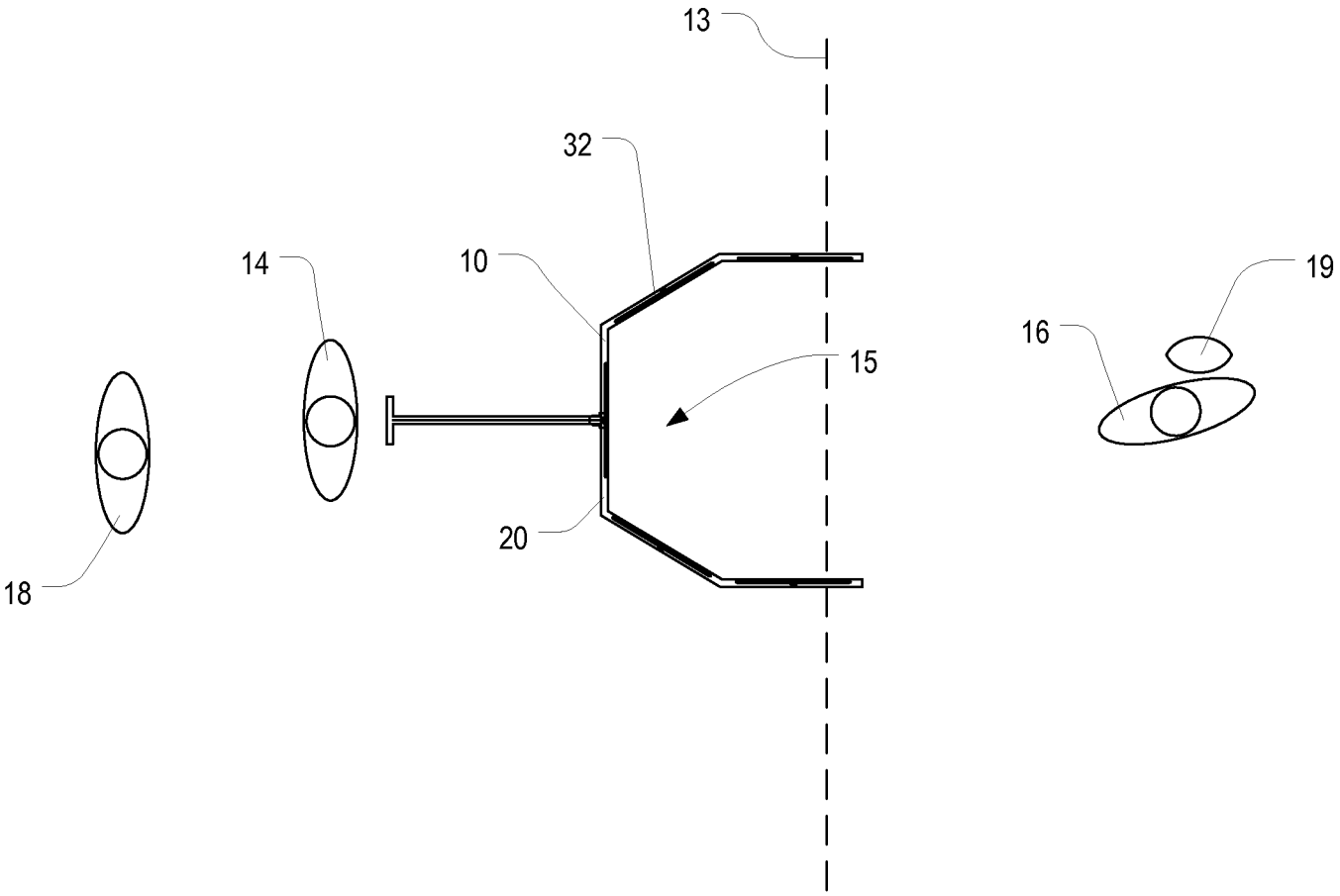
Figure 4C:
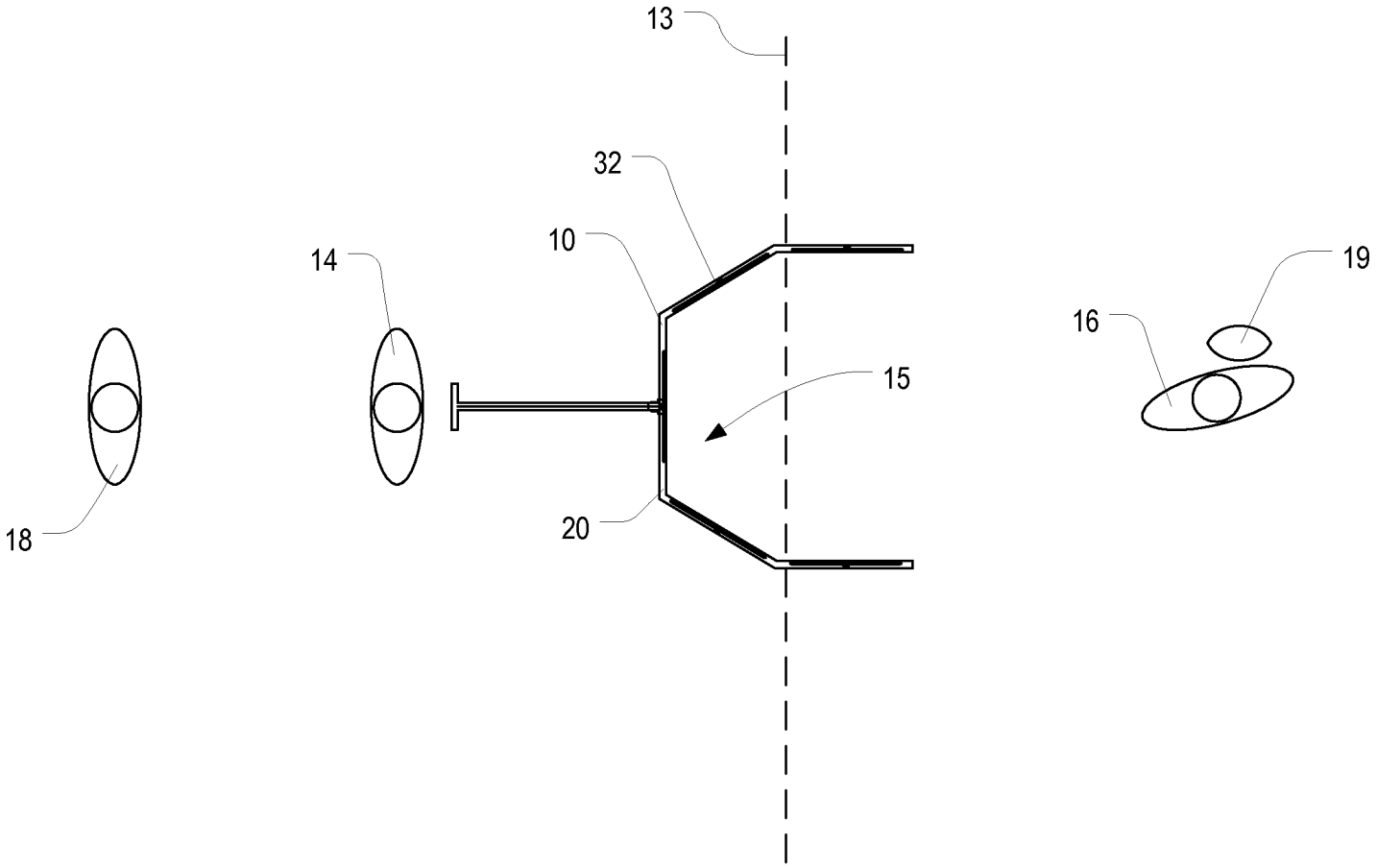

FIGS. 4A-4G are overhead schematic views of the football training device 10, coach 14, and quarterback 16 of FIG. 3, illustrating a first drill. In FIG. 4A, the quarterback 16 is set up to throw to a receiver 18 (who may in fact be another player, another coach, or simply a volunteer assisting with the drill). An approximate line of scrimmage 13 is established for drill purposes, the quarterback 16 sets up behind the line of scrimmage 13, and the coach 14 positions the training device 10 on the defensive side of the line 13. On command, the quarterback 16 drops back to pass the ball 19, and the coach 14 pushes the training device 10 toward the quarterback 16 at a rate of speed selected to simulate that of a defensive rush, as shown in FIGS. 4B and 4C.

Notably, as the device 10 is moved toward the quarterback 16, the mannequins 32 simulate the look and feel of a group of defensive players rushing the quarterback 16, complete with their arms outstretched to visually block the quarterback's line of sight and physically block the quarterback's throwing lanes. Furthermore, the arrangement of the mannequins 32 in a "U" or arc around the base frame 20 mimics the creation of a "pocket" 15 that is conventionally established by offensive linemen to protect the quarterback 16. The overall experience, from the point of view of the quarterback 16, is much more realistic than simply imagining those defensive players as he goes through his drills.

Figure 4D:
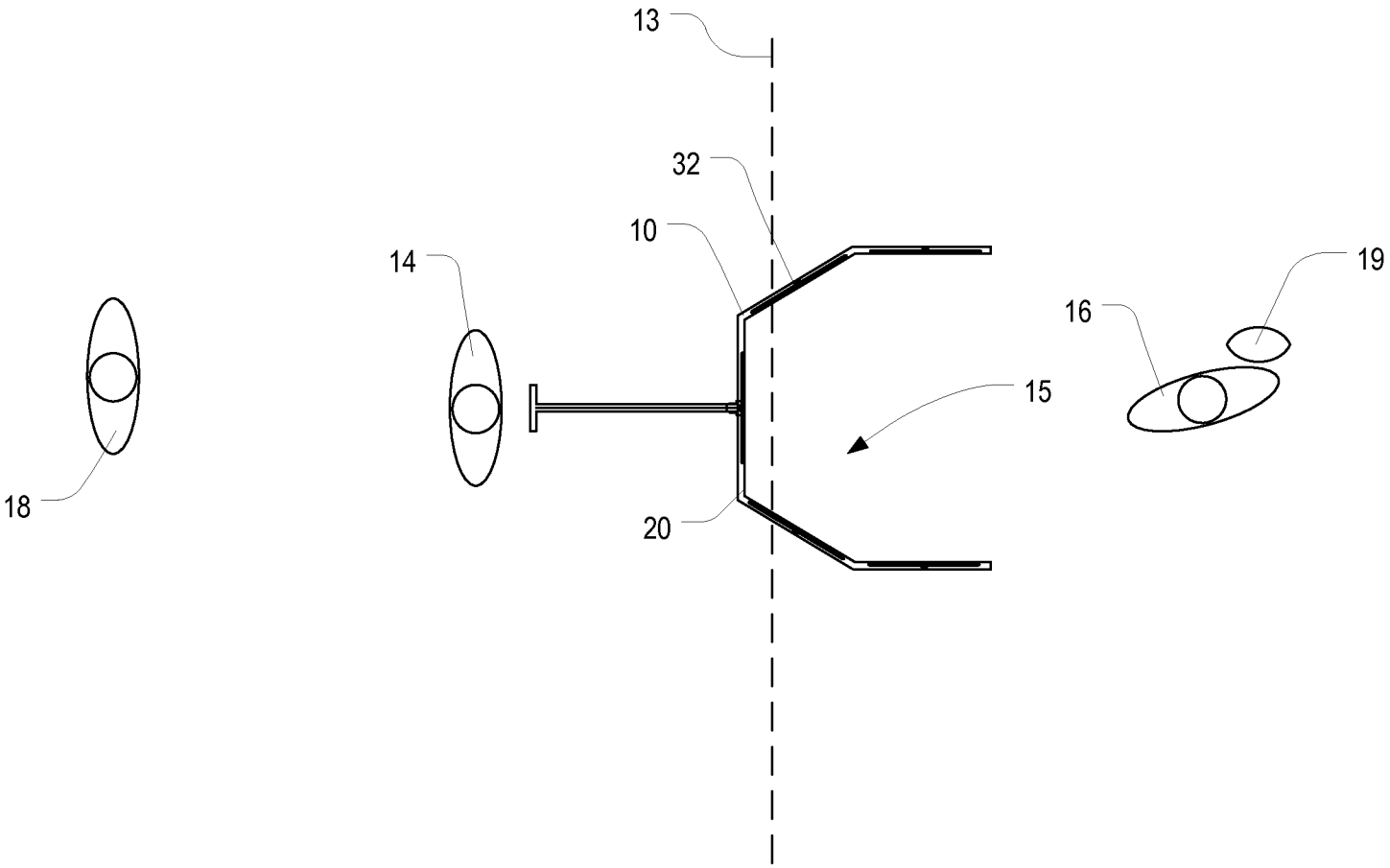
Figure 4E:
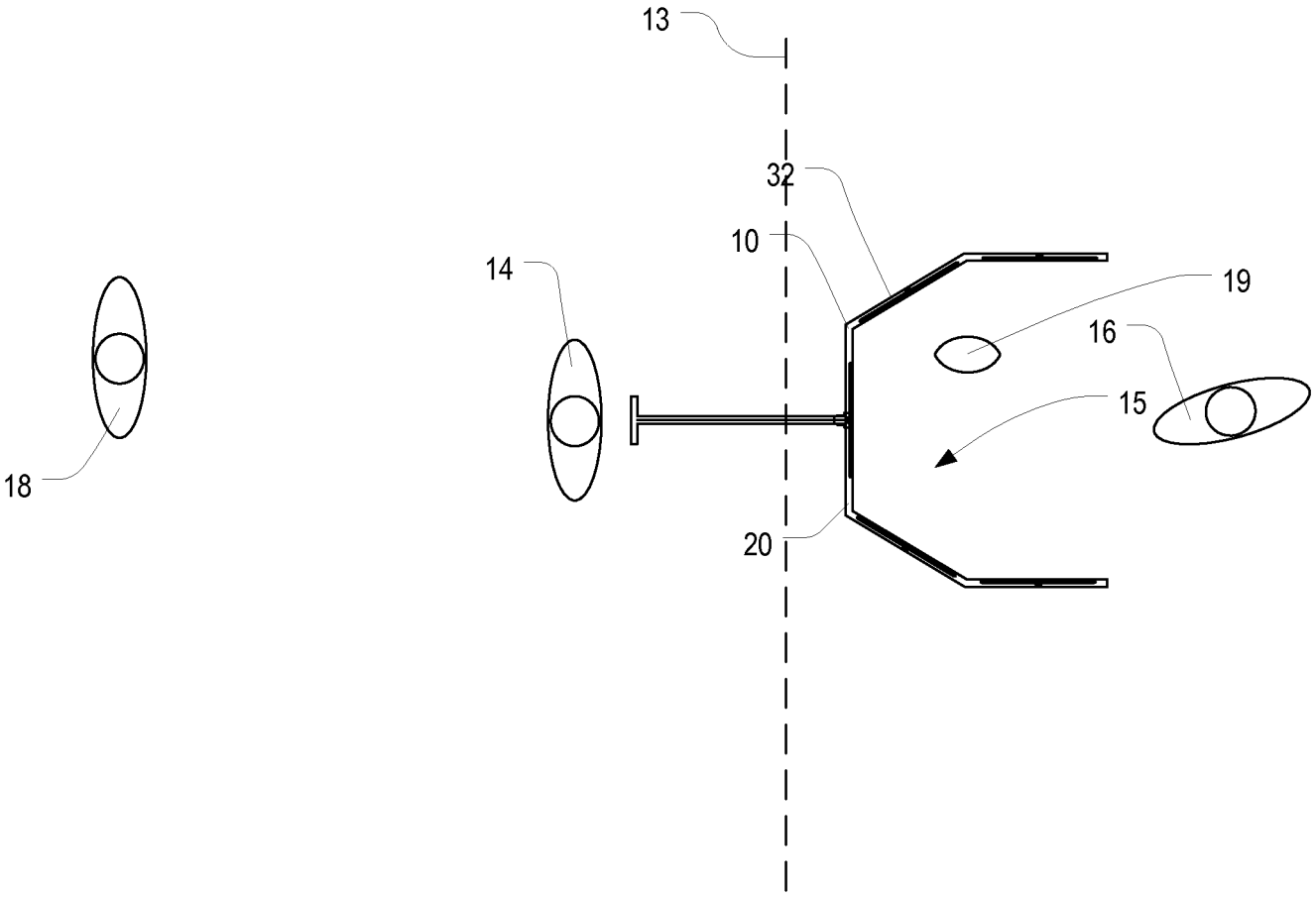
Figure 4F:
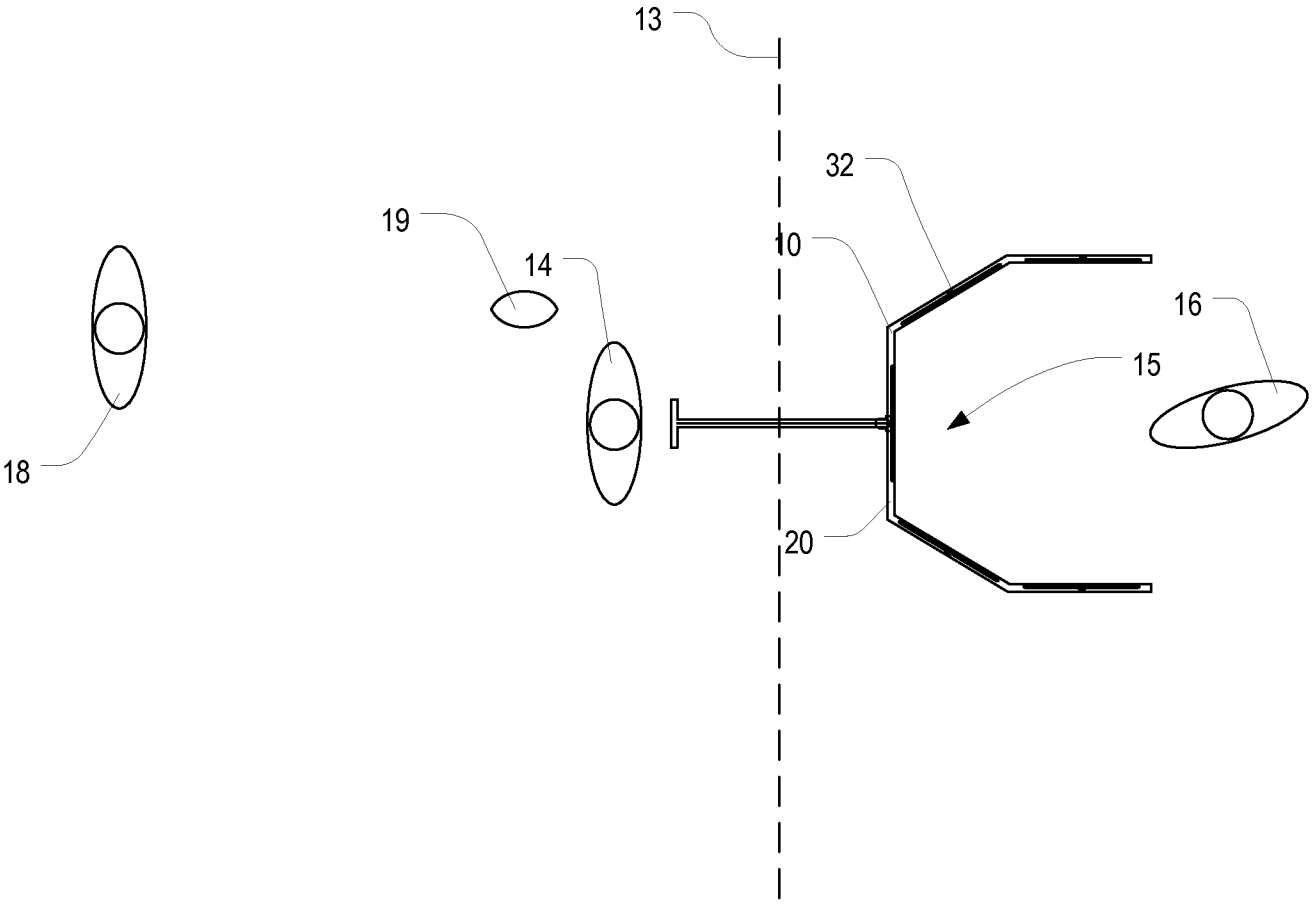
Figure 4G:
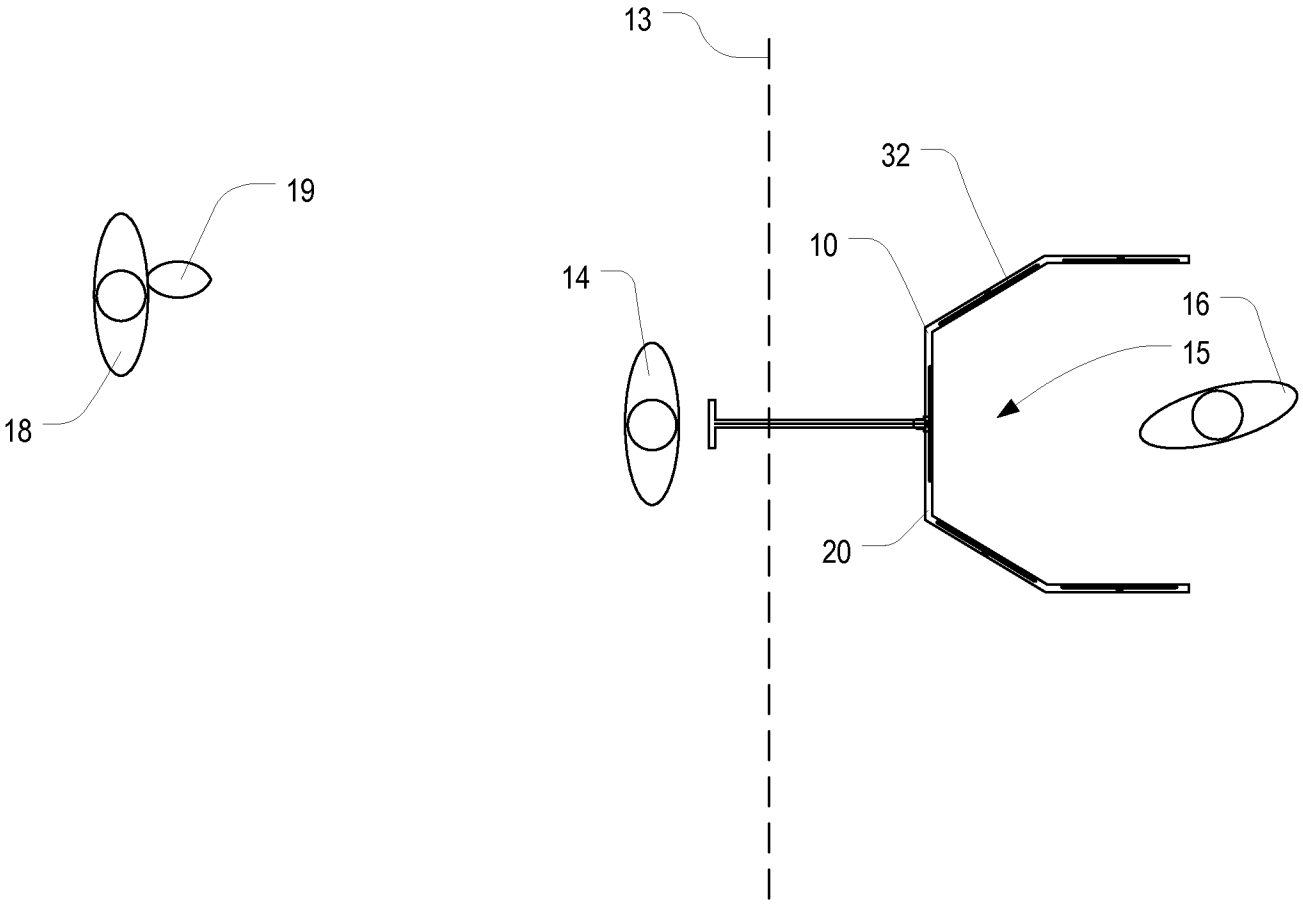

Completion of the drill is shown in FIGS. 4D-4G. In FIG. 4D, with the pocket 15 beginning to collapse on the quarterback 16, the quarterback 16 initiates his throw, attempting to complete a pass to a receiver 18 without hitting the mannequins 32. Movement of the device 10 once the ball 19 is thrown, as shown at FIGS. 4E and 4F, is somewhat less important, but still conditions the quarterback 16 to the defensive rush. Finally, the accuracy of the throw may be observed by the completion of the pass (or not) to the receiver 18, as shown in FIG. 4G. The ball 19 may then be returned to the quarterback 16 (or another ball retrieved), the coach 14 may return the device 10 to the other side of the line of scrimmage 13, and the drill can be repeated.

Figure 5A:
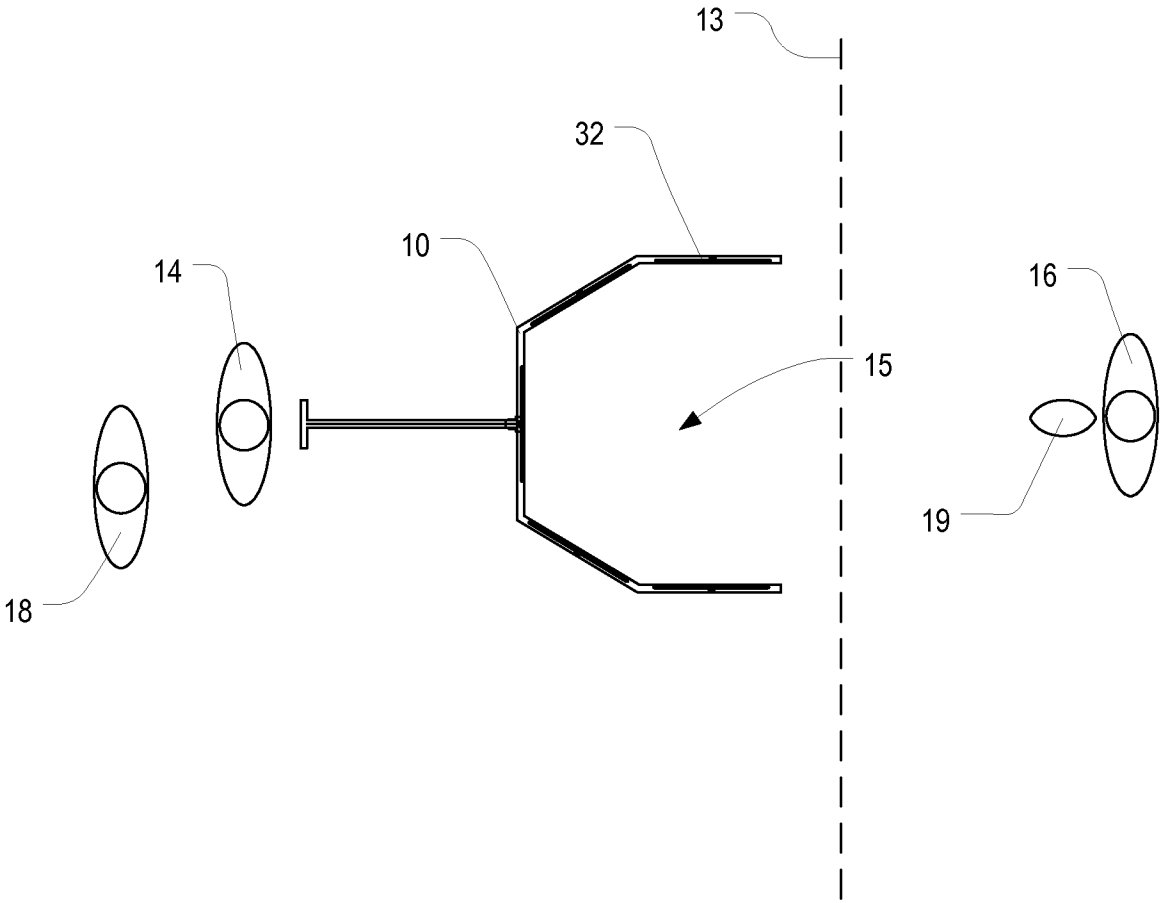
FIGS. 5A-5G are overhead schematic views of the football training device, coach, and quarterback of FIG. 3, illustrating a second drill.
Figure 5B:
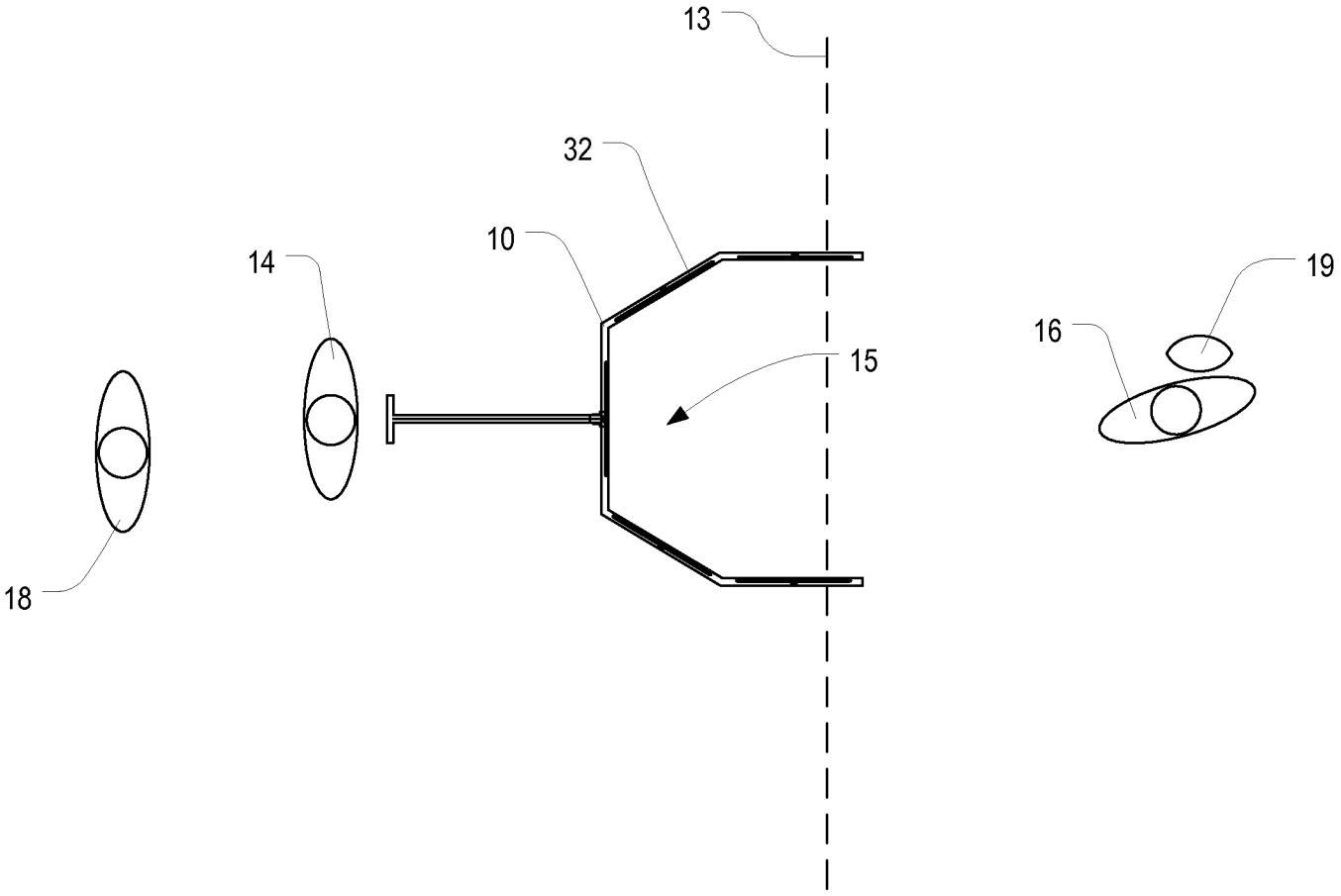
Figure 5C:
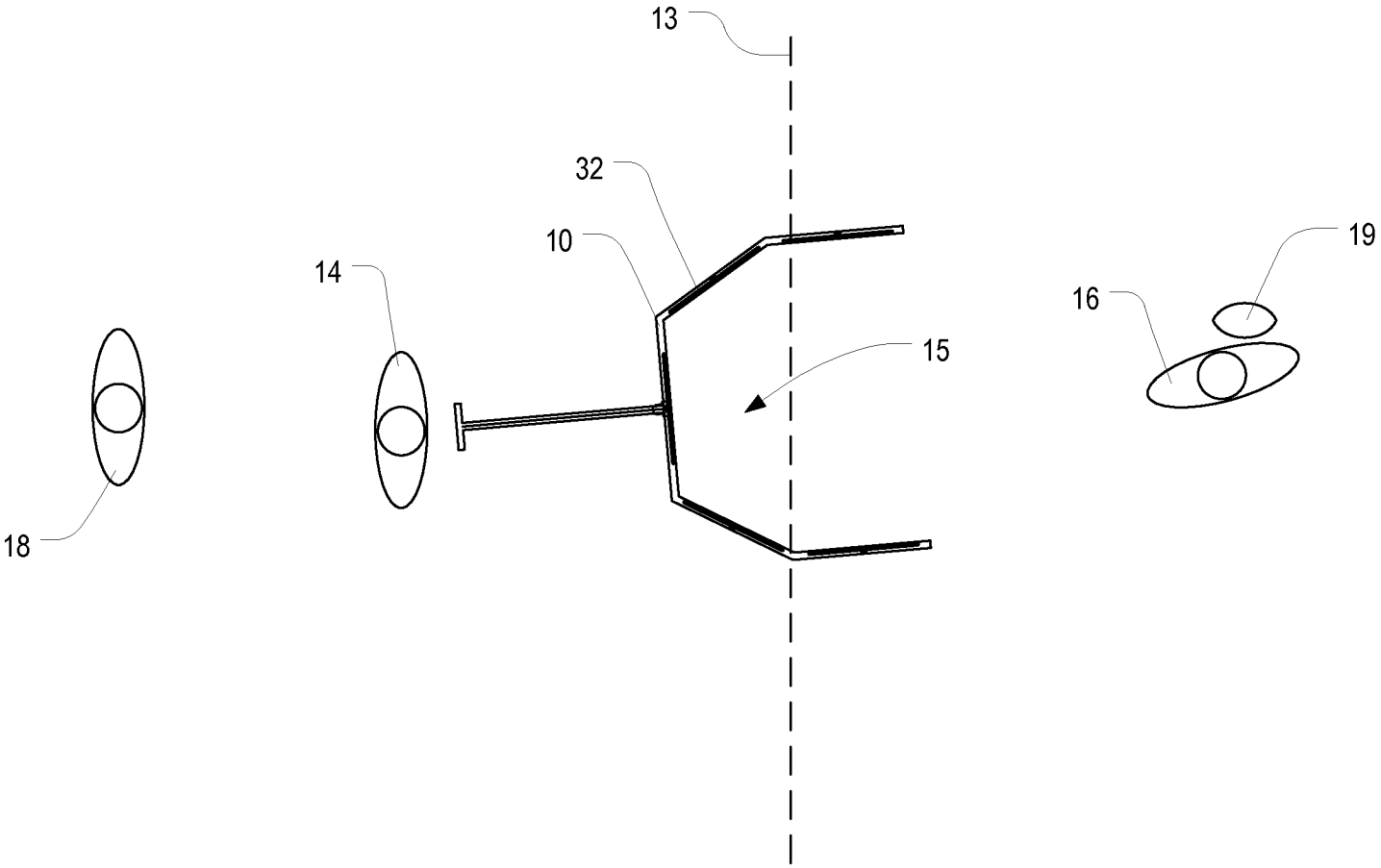

FIGS. 5A-5G are overhead schematic views of the football training device 10, coach 14, and quarterback 16 of FIG. 3, illustrating a second drill. In FIG. 5A, the quarterback 16 is once again set up to throw to a receiver 18 (who may in fact be another player, another coach, or simply a volunteer assisting with the drill). An approximate line of scrimmage 13 is established for drill purposes, the quarterback 16 sets up behind the line of scrimmage 13, and the coach 14 positions the training device 10 on the defensive side of the line 13. On command, the quarterback 16 drops back to pass the ball 19, and the coach 14 pushes the training device 10 toward the quarterback 16 at a rate of speed selected to simulate that of a defensive rush, as shown in FIGS. 5B and 5C.

Figure 5D:
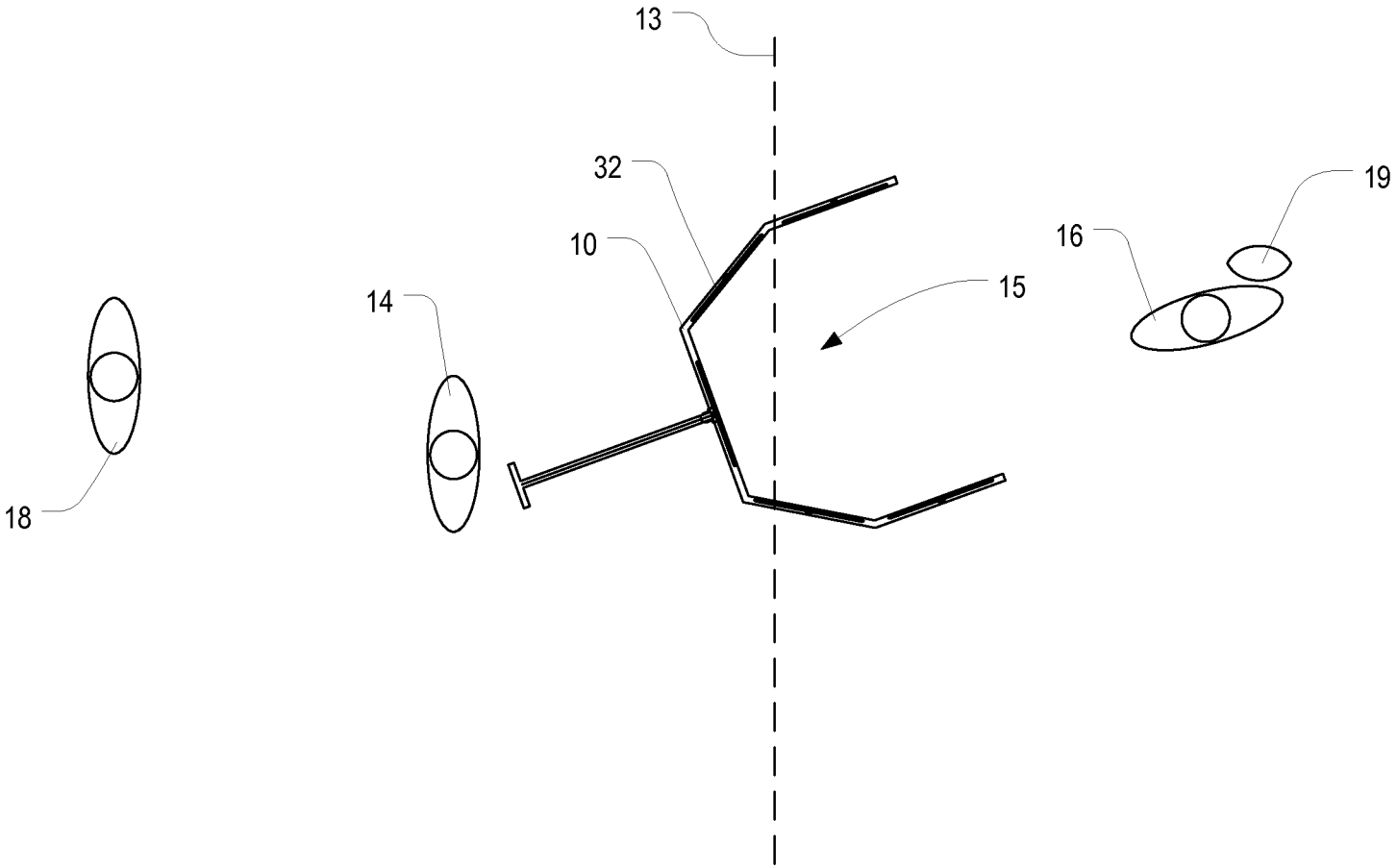

Once again, as the device 10 is moved toward the quarterback 16, the mannequins 32 simulate the look and feel of a group of defensive players rushing the quarterback 16, complete with their arms outstretched to visually block the quarterback's line of sight and physically block the quarterback's throwing lanes. However, as the drill continues, the coach 14 begins to pivot the device 10, as shown in FIG. 5C, thereby simulating the weakening or collapse of one side of the offensive line and thus the pocket 15. As a result, the quarterback is trained to move or "roll" away from the pressure thus created by the defensive rush as shown in FIG. 5D. Once again, the overall experience, from the point of view of the quarterback 16, is much more realistic than simply imagining those defensive players as he goes through his drills.

Figure 5E:
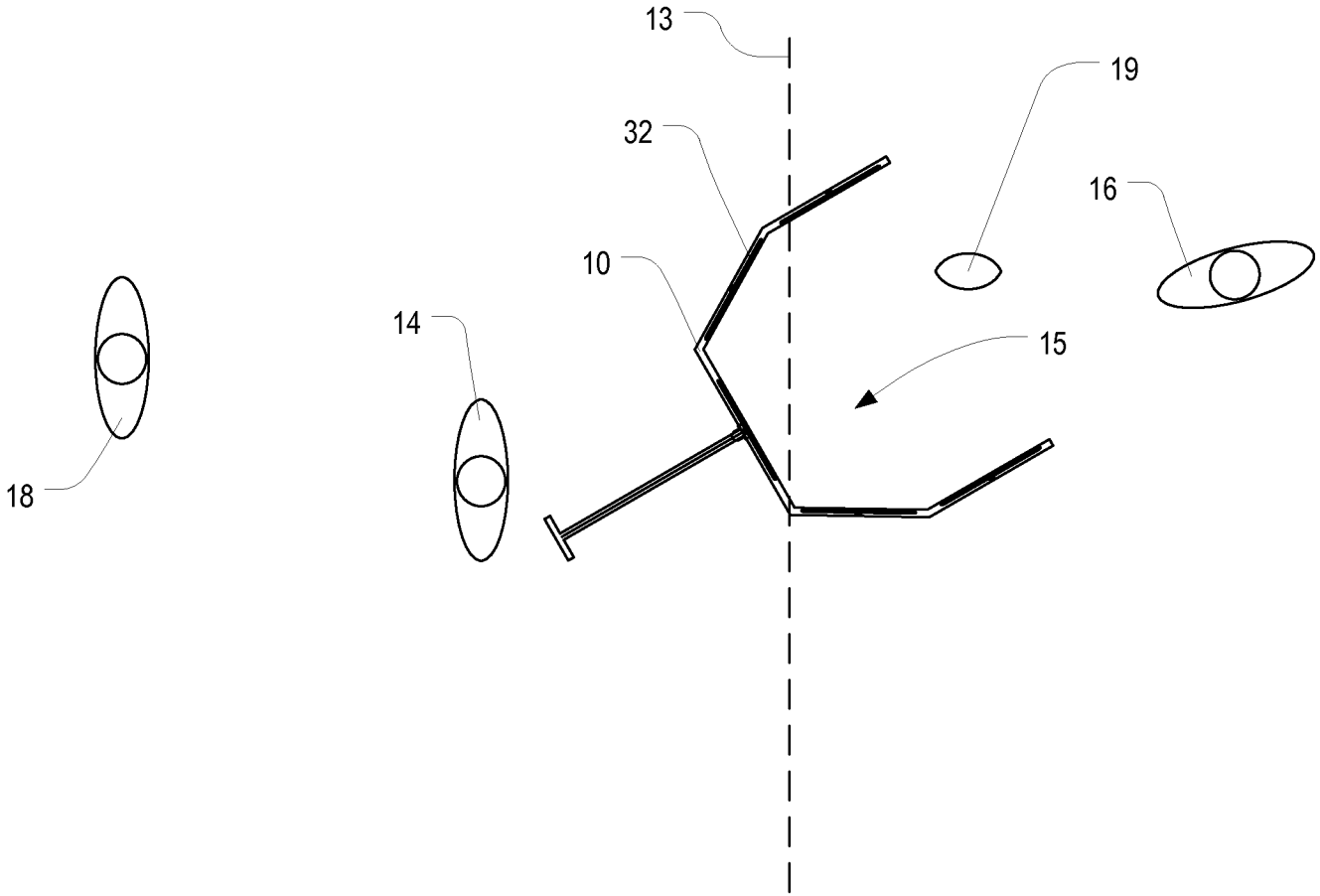
Figure 5F:
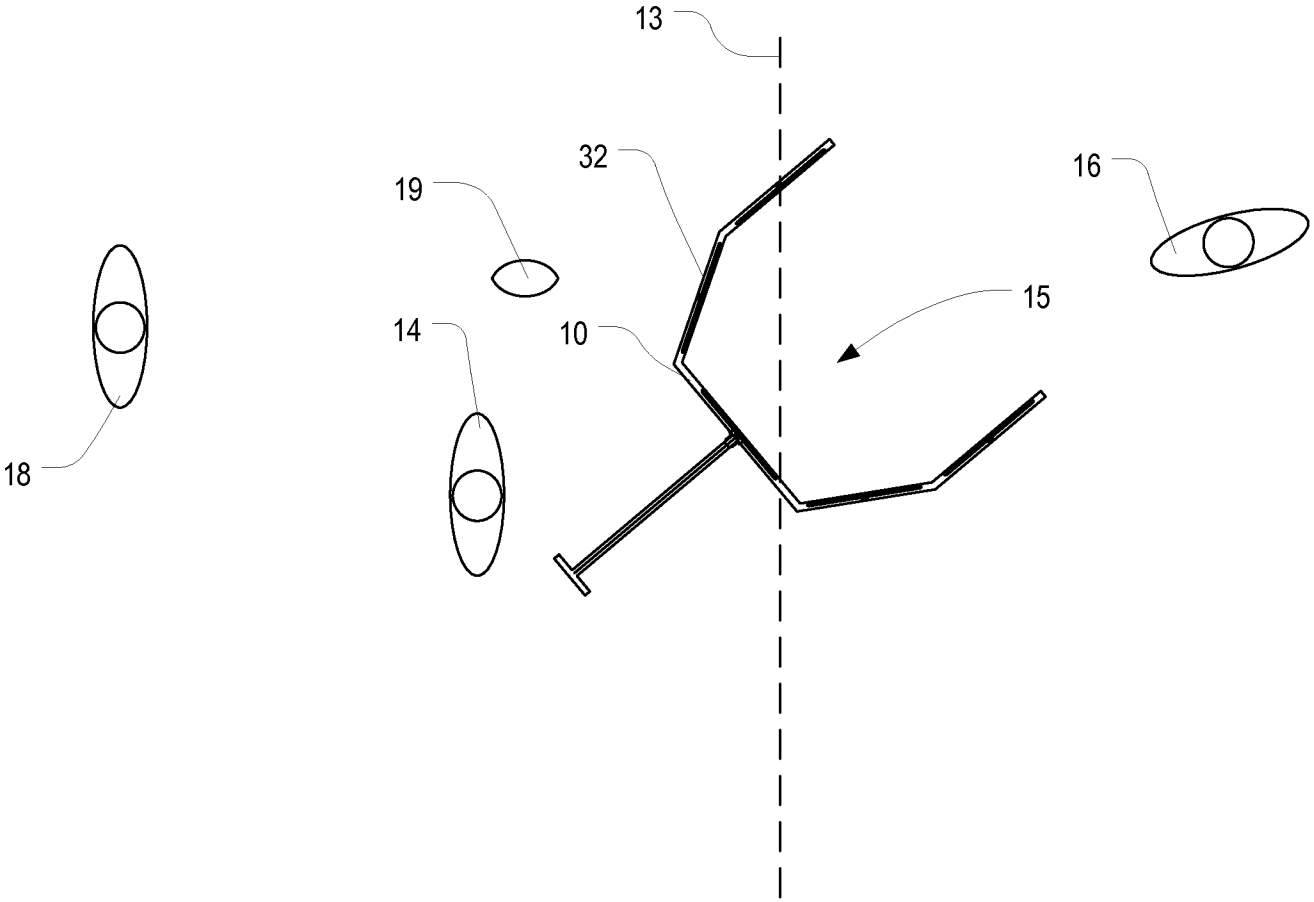
Figure 5G:
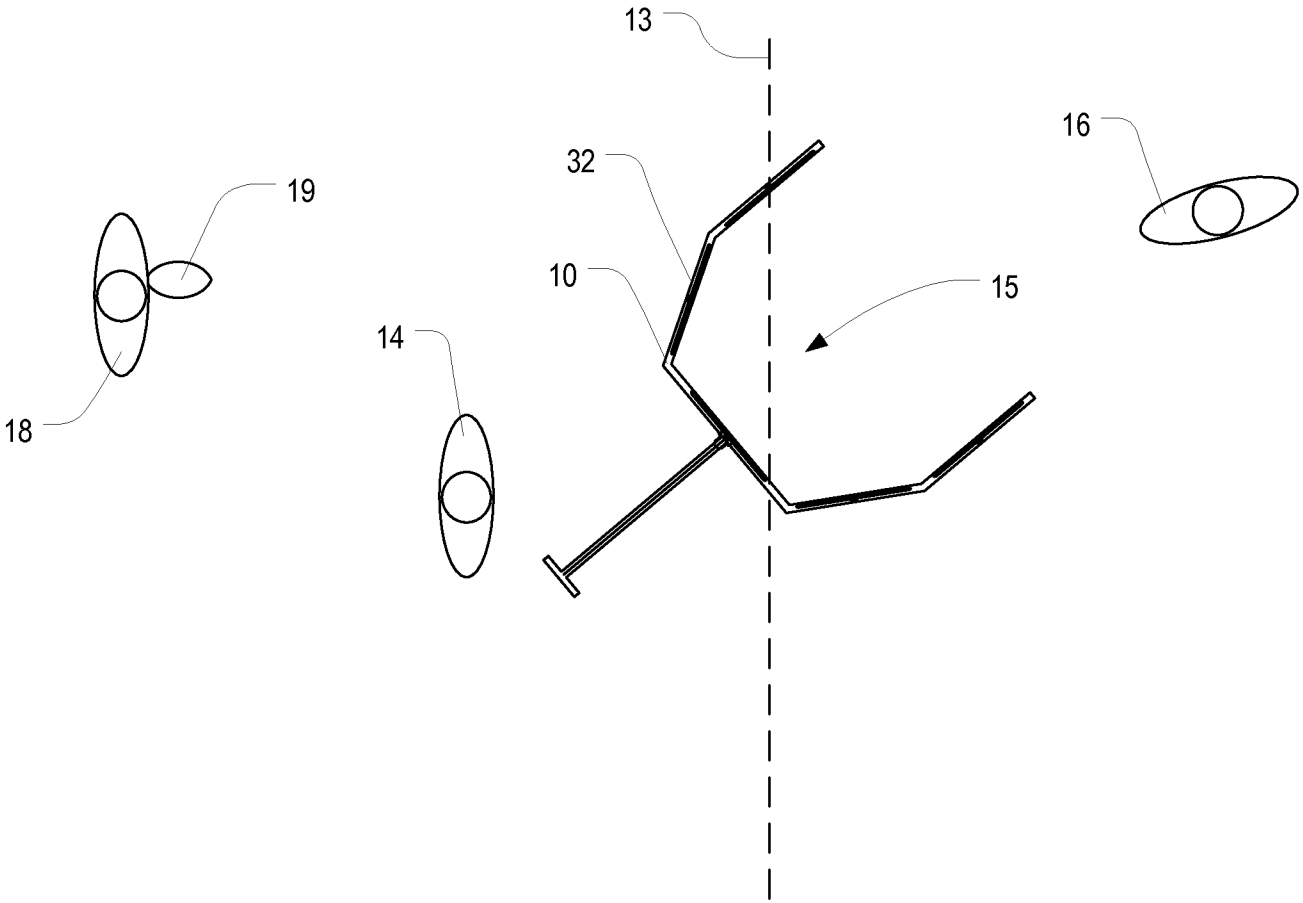

Completion of the drill is shown in FIGS. 5D-5G. In FIG. 5D, as the quarterback 16 rolls away from the rush, the quarterback 16 initiates his throw, attempting to complete a pass to the receiver 18 without hitting the mannequins 32. Movement of the device 10 once the ball 19 is thrown, as shown at FIGS. 5E and 5F, is somewhat less important, but still conditions the quarterback 16 to the defensive rush. Finally, the accuracy of the throw may be observed by the completion of the pass (or not) to the receiver 18, as shown in FIG. 5G. The ball 19 may then be returned to the quarterback 16 (or another ball retrieved), the coach 14 may return the device 10 to the other side of the line of scrimmage 13, and the drill can be repeated.

Although not specifically illustrated, similar drills may be executed for kickers and punters. For example, working with or without a snapper (or holder), a coach 14 may push the device 10 toward the kicker or punter while such player executes his kick. The presence of the mannequins 32 once again creates both a visual and physical obstacle for the player, thereby giving him a more realistic simulation of game conditions than was previously possible. One particular benefit is the emphasis placed on making sure the player elevates his kick to get it over the onrushing defensive players represented by the mannequins 32. Although not illustrated, the orientation of the obstacles 30 may also be changed so as to more accurately simulate game conditions. For example, the obstacles 30 could be oriented at an acute angle (such as 45 degrees) relative to the ground to simulate kick blockers diving in front of a punter. In some embodiments, the mount 36, post 42, or other portion of each obstacle 30 may be adjustable such that the mannequin 32 may be oriented vertically (as shown in FIGS. 1-3) or at an acute angle so as to be able to use such a football training device in different ways, such as to facilitate different drills for different players.

In some embodiments, the height of the mannequins 32 is adjustable as to make the device 10 usable with different age groups, skill levels, or the like, while in other embodiments, the height of the mannequins 32 is not adjustable, but mannequins 32 are manufactured in different sizes for such purpose. For use with professional players, the mannequins 32 may, for example, be installed such the top of the head of each mannequin 32 is approximately six and half feet off the ground, with the arms extending above that, while for youth players, the mannequins 32 may be installed such that top of the head is much lower.

Figure 6:
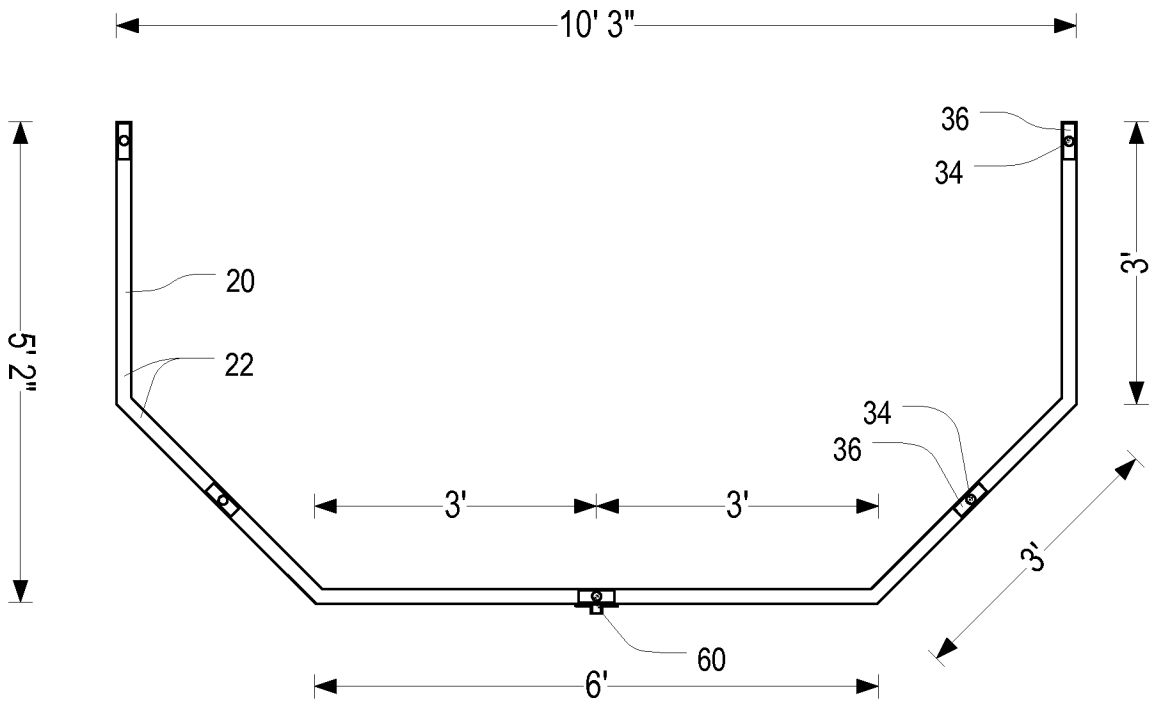
FIG. 6 is a top cross-sectional view of the device of FIG. 2, taken along line 6-6.

Likewise, in some embodiments, the width of the base frame 20 is adjustable so as to make the device 10 usable with different age groups, skill levels, or the like, while in other embodiments, the base frame 20 is manufactured in different widths for such purpose. For use with professional players, the base frame 20 may, for example, be eight to fifteen feet wide, while for youth players, the base frame 20 may be only six to ten feet wide. In at least some of these embodiments, the outermost mannequins 32 are a corresponding distance apart. Approximate dimensions for one exemplary implementation of the base frame 20 are shown in FIG. 6, which is a top cross-sectional view of the device 10 of FIG. 2, taken along line 6-6.

Figure 7:
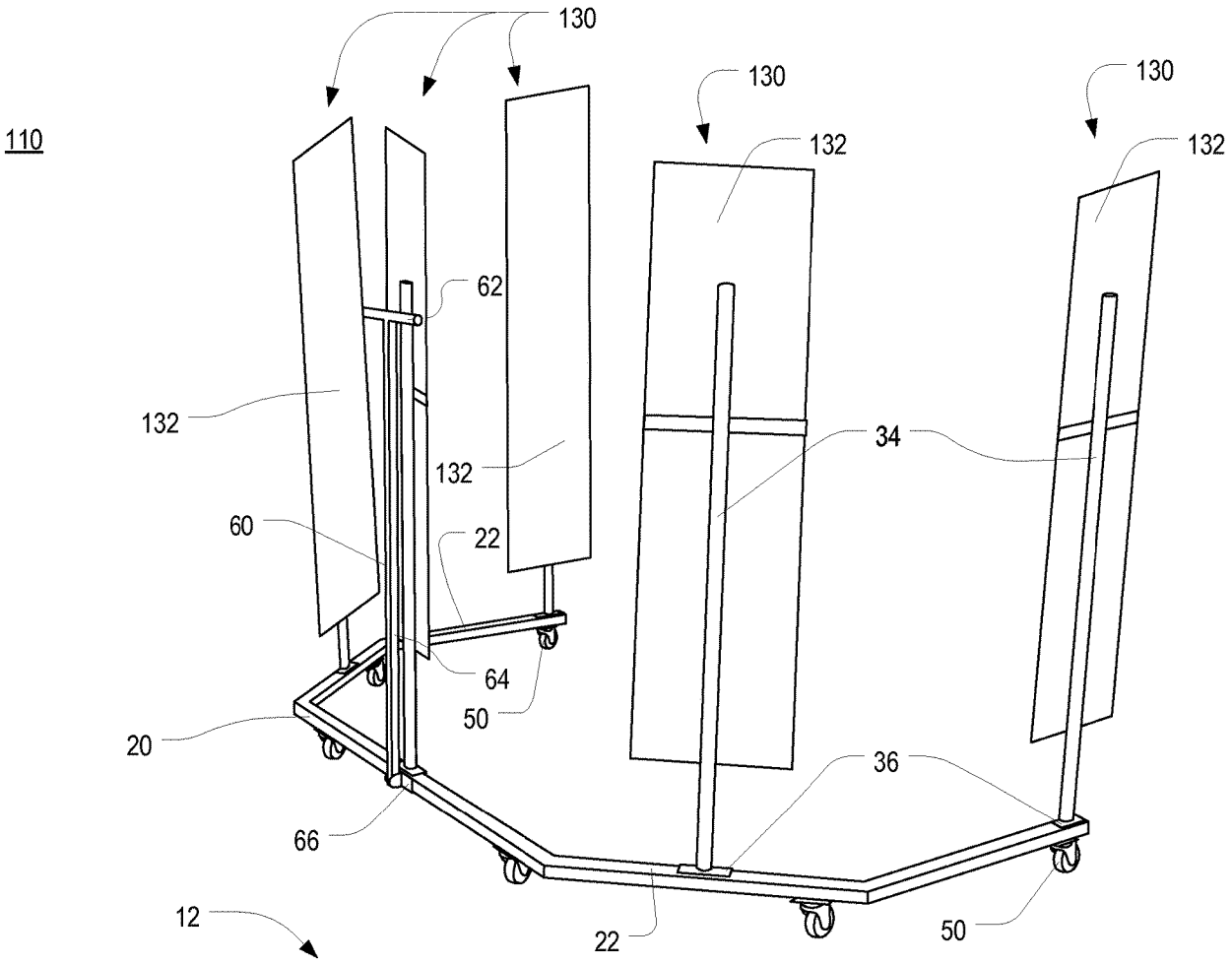
FIG. 7 is a front perspective view of a football training device similar to that of FIG. 2, but with panels instead of mannequins.

It will be appreciated that in some embodiments, the obstacles do not have to include mannequins or otherwise resemble humans or human figures. For example, one or more of the obstacles could simply include a panel, plurality of elongate members, or the like. In this regard, FIG. 7 is a front perspective view of a football training device 110 similar to that of FIG. 2, but with obstacles 130 that include panels 132 instead of mannequins. In at least some such embodiments, the panels 132 or other structures of the obstacles 130 are of a size (maximum or average width and height) that is comparable to that of the mannequins 32 described herein.

As exemplified in the drills described above, the device 10 makes it possible for a single coach 14 to create a realistic simulation of movement and feel for a quarterback, kicker/punter, or other player, all without use of additional personnel. The result is far more effective than the player merely "working on air," and it is even possible to substitute the device 10 for actual personnel in at least some drills, thereby freeing up those personnel for other tasks.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A football training device for replicating a defensive rush, comprising:

a base frame;

a plurality of obstacles extending upward from the base frame; and a plurality of wheel assemblies, arranged non-linearly, supporting and carrying the full weight of the base frame and the obstacles;

wherein in a first use state the base frame is stationary, and in a second state the base frame is in movement over a football field to simulate a defensive rush for a quarterback, kicker, punter, or other offensive football player while executing a drill; and wherein the weight of the base frame and the obstacles is carried and fully supported on the wheel assemblies, without being propped up by a non-wheeled support, such that base frame and obstacles remain upright in both the first state and the second state.

2. The football training device of claim 1, wherein each obstacle includes a mannequin, a support member or frame, and a mount, wherein the support member or frame is connected to the base frame via the mount and wherein the mannequin is carried on the support member or frame.

3. The football training device of claim 2, wherein each mannequin is in the form of a silhouette of a human body.

4. The football training device of claim 2, wherein each mannequin includes a panel of cloth mesh.

5. The football training device of claim 4, wherein each mannequin includes a wire frame on which the panel of cloth mesh is carried.

6. The football training device of claim 1, further comprising a handle, connected to the base frame, for pushing or pulling the base frame, thereby imparting movement to the device.

7. The football training device of claim 6, wherein the handle has a height that is adjustable to provide greater control for a person pushing or pulling the device.

8. The football training device of claim 1, wherein the obstacles resemble the approximate size and shape of human figures representing defensive players rushing the offensive football player.

9. The football training device of claim 8, wherein each obstacle has a height that is adjustable.

10. The football training device of claim 1, wherein the base frame is in the shape of an open-ended "U" or arc as viewed from above.

11. The football training device of claim 10, wherein the "U"-shape of the base frame comprises at least three intersecting line segments formed by interconnecting portions of the base frame.

12. The football training device of claim 1, wherein the plurality of obstacles are arranged in a "U" or arc when viewed from above so as to simulate a defensive rush against the offensive football player.

13. The football training device of claim 1, wherein each obstacle extends upward to an elevation of between five and a half feet and eleven feet above the ground.

14. The football training device of claim 1, wherein the obstacles extend vertically from the base frame.

15. A football training device for replicating a defensive rush, comprising:

a base frame;

at least three obstacles extending upward from the base frame and arranged to partially surround a central area in which a quarterback, kicker, punter, or other offensive football player may move while executing a drill; and one or more wheel assemblies supporting the base frame;

wherein the base frame may be pushed or pulled over a football field, thereby moving the central area relative to the offensive player while executing the drill.

16. The football training device of claim 15, wherein each obstacle includes a mannequin, a support member or frame, and a mount, wherein the support member or frame is connected to the base frame via the mount and wherein the mannequin is carried on the support member or frame.

17. The football training device of claim 15, further comprising a handle, connected to the base frame, for pushing or pulling the base frame, thereby imparting movement to the device, the handle having a height that is adjustable to provide greater control for a person pushing or pulling the device.

18. The football training device of claim 15, wherein the obstacles resemble the approximate size and shape of human figures representing defensive players rushing the offensive football player, wherein each obstacle has a height that is adjustable, and wherein each obstacle extends upward to a maximum elevation of between five and a half feet and eleven feet above the ground.

19. A football training device for replicating a defensive rush, comprising:

a base frame having at least three co-planar segments, each of the three segments being an elongate member, wherein the at least three segments include a central elongate member, a first elongate wing member extending at a non-collinear angle from a first end of the central elongate member, and a second elongate wing member extending at a non-collinear angle from a second end of the central elongate member such that the first and second elongate wing members are separate from each other, such that the distal ends of the first and second wing members are unconnected from other portions of the base frame, and define an open space therebetween such that the base frame is in the shape of an open-ended "U" or arc as viewed from above;

a plurality of mannequin obstacles, wherein each mannequin extends upward from a respective segment of the base frame; and at least three wheel assemblies supporting the base frame, the wheel assemblies being spaced apart along the extent of the base frame such that they are in non-linear relationship with one another;

wherein the base frame may be pushed or pulled over a football field, thereby moving the central area relative to an offensive player while executing a drill.

* * * * *